US006752773B2

(12) United States Patent
Leung et al.

(10) Patent No.: US 6,752,773 B2
(45) Date of Patent: Jun. 22, 2004

(54) BUBBLING BATH MAT

(75) Inventors: Anthony Kit Lun Leung, Hong Kong (CN); Chung Shun Tse, Hong Kong (CN); Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 22 days.

(21) Appl. No.: 09/943,056

(22) Filed: Aug. 30, 2001

(65) Prior Publication Data

US 2003/0045819 A1 Mar. 6, 2003

(51) Int. Cl.[7] ..... A61H 33/02
(52) U.S. Cl. ..... 601/158; 601/168; 4/541.5
(58) Field of Search ..... 601/154, 155, 601/156, 157, 158, 159, 160, 167, 168; 4/541.1, 541.5

(56) References Cited

U.S. PATENT DOCUMENTS

| | | | | |
|---|---|---|---|---|
| 3,809,073 A | | 5/1974 | Baumann | 128/66 |
| D233,485 S | | 10/1974 | Kulisch | D83/1 C |
| 3,870,040 A | | 3/1975 | Kulisch | 128/66 |
| 4,048,266 A | | 9/1977 | Baumann | 261/122 |
| 4,269,797 A | | 5/1981 | Mikiya | 261/122 |
| 4,409,693 A | | 10/1983 | Baumann | 4/543 |
| 4,417,568 A | | 11/1983 | Nozawa et al. | 128/33 |
| D288,607 S | | 3/1987 | Baumann et al. | D24/38 |
| 4,780,916 A | * | 11/1988 | Sutton | 601/168 |
| D299,062 S | | 12/1988 | Young et al. | D24/38 |
| D299,063 S | | 12/1988 | Young et al. | D24/38 |
| D305,687 S | | 1/1990 | Walczak et al. | D24/38 |
| D306,345 S | | 2/1990 | Walczak et al. | D24/38 |
| D310,877 S | | 9/1990 | Reeves et al. | D24/38 |
| 4,962,759 A | | 10/1990 | Stern et al. | 128/66 |
| D312,129 S | | 11/1990 | Peterson et al. | D24/38 |
| 4,984,583 A | | 1/1991 | Peterson et al. | 128/66 |
| D319,106 S | | 8/1991 | Bucher | D24/201 |
| 5,050,591 A | | 9/1991 | Sandrin | 128/65 |
| 5,080,091 A | | 1/1992 | Peterson et al. | 128/66 |
| 5,090,403 A | | 2/1992 | Bucher | 128/66 |
| 5,110,512 A | | 5/1992 | Kwon | 261/122 |
| D431,866 S | | 10/2000 | Wu | D24/201 |
| 6,277,086 B1 | * | 8/2001 | Wu | 601/168 |
| 2001/0044589 A1 | | 11/2001 | Ferber et al. | 601/168 |

FOREIGN PATENT DOCUMENTS

| | | |
|---|---|---|
| DE | 28 54 503 | 6/1980 |

* cited by examiner

*Primary Examiner*—Danton D. DeMille
*Assistant Examiner*—Quang D Thanh
(74) *Attorney, Agent, or Firm*—Ohlandt, Greeley, Ruggiero & Perle, LLP

(57) ABSTRACT

There is provided a foldable bubbling bath mat having two or more interconnected segments and a number of air channels with two or more apertures located in a bottom surface of the air channels. The bubbling bath mat is adapted to produce varying sized air bubbles and, thus, improve the overall therapeutic massaging effect on a user.

3 Claims, 6 Drawing Sheets

BUBBLING BATH MAT

BACKGROUND OF THE INVENTION

1. Field of the Invention

The present invention relates to a bath mat. More particularly, the present invention relates to a bubbling bath mat that provides a bubbling massage having a therapeutic aeration effect. The present invention also provides a foldable mat for easy handling and storage.

2. Description of the Prior Art

Examples of bubbling bath mats relating to the present invention and demonstrating the state of the art can be found in U.S. Pat. Nos. 5,090,403; 5,080,091; 4,962,759; 4,417,568; 4,409,693; and 3,809,073. In addition, German Patent Nos. 2,854,503 and 4,033,021 also reflect the state of the art.

All of the above provide for bubbling bath mats that introduce air into a body of water through a plurality of apertures located in an upper and/or side surface of the mat. The drawbacks associated with these different configurations include: (1) upper surface apertures can be blocked by a user's body, and (2) side surface apertures have a dissipated therapeutic massaging effect since only a limited area of the body of water is affected.

The present invention addresses the above-mentioned deficiencies by providing a bubbling bath mat adapted such that air escapes through a plurality of small apertures from a bottom surface of one or more air channels. This arrangement improves aeration for improved therapeutic massaging effect. In addition to the foregoing, the present invention is distinct over the prior art in that it provides for a bubbling bath mat having four or more distinct rigid segments, which not only allow for greater flexibility in positioning the mat within a tub, but also allow the mat to be folded up on itself. The present invention also provides for a bubbling bath mat having a plurality of soft pads affixed to the surface of one or more of the rigid segments. Moreover, the present invention provides for a bubbling bath mat adapted to produce differently sized bubbles.

SUMMARY OF THE INVENTION

It is an object of the present invention to provide a bubbling bath mat with an improved aeration effect.

It is another object of the present invention to provide such a bubbling bath mat adapted to produce bubbles of different sizes.

It is still another object of the present invention to provide such a bubbling bath mat with an adjustable valve means.

It is yet another object of the present invention to provide such a bubbling bath mat that can be folded into a compact unit for convenient handling and storage.

It is still yet further another object of the present invention to provide detachable/adjustable attachments that can be used with the bubbling bath mat.

It is a further object of the present invention to provide a bubbling bath mat that has soft padding adapted to provide improved comfort without inhibiting aeration.

It is still a further object of the present invention to provide such a bubbling bath mat configured to adjustably fit in a tub or basin.

These and other objects and advantages of the present invention are achieved by a bubbling bath. The mat is preferably adapted for use with a device for emitting compressed air into the mat. The mat has an elongated body with a plurality of interconnected segments and air channels, an air distributor controller. The surface of each segment has a plurality of differently sized apertures for producing bubbles of different size. The surface of one or more of the segments being preferably adapted with a plurality of soft pads having apertures therein that correspond in size and shape to the plurality of differently sized apertures in the surface of each segment. The segments preferably extend the entire width of the mat. The segments are connected at a plurality of joints. Each joint preferably has a pair of link hinges laterally spaced and diametrically opposed and secured along the outer edges of each segment. The joints allow the mat to be compactly folded for easy handling and storage.

The present invention provides for an improved bubbling bath mat having a better aeration and therapeutic massaging effect, and being adapted to be folded into a compact size for easy transport and storage.

DETAILED DESCRIPTION OF THE INVENTION

Figure 1:
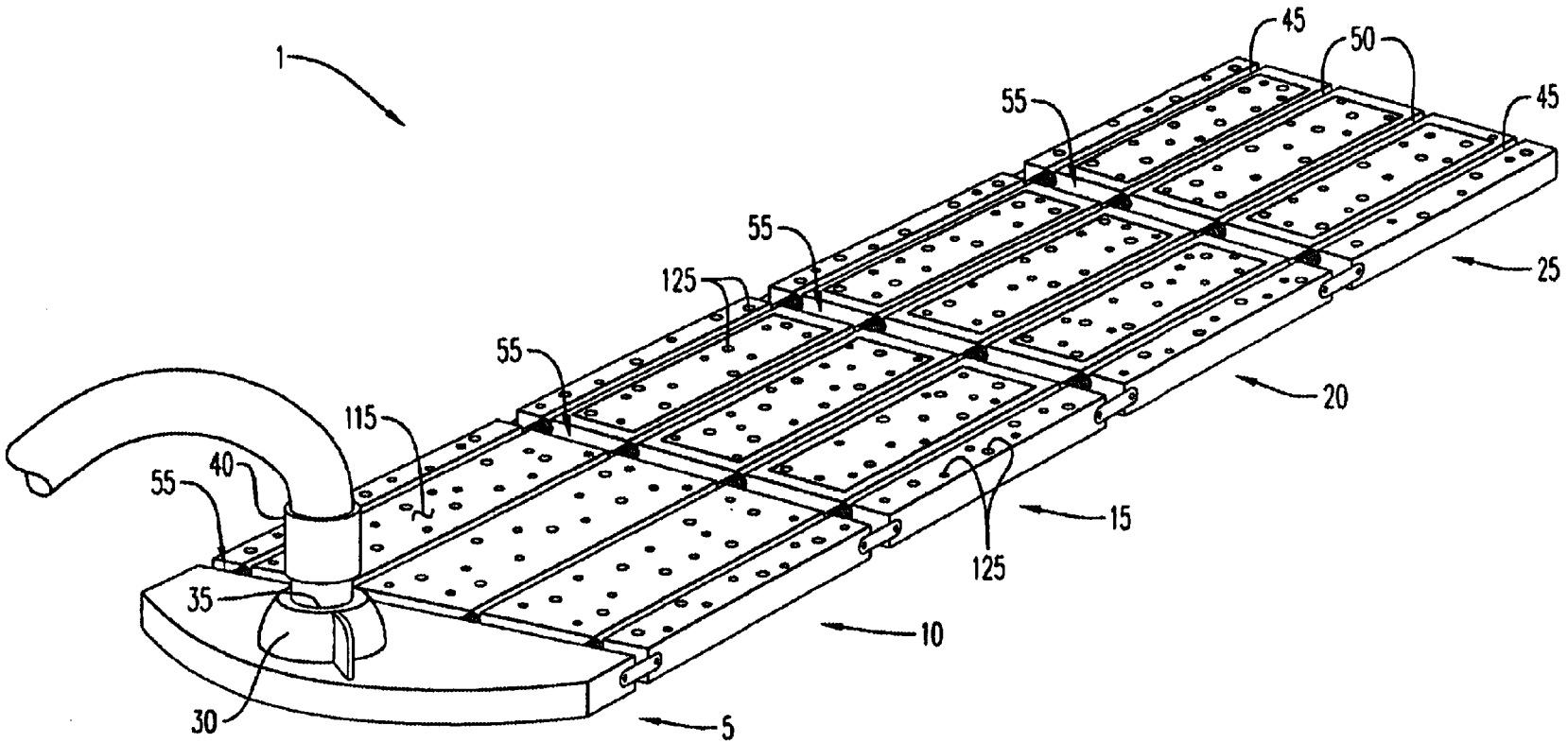
FIG. 1 is a perspective view of a bubbling bath mat, in accordance with a preferred embodiment of the present invention.

Referring to the drawings and more particularly to FIG. 1, there is shown a bubbling bath mat in accordance with a preferred embodiment of the present invention generally represented by reference numeral 1. Bubbling bath mat 1, preferably, has a plurality of longitudinally disposed segments, including a head segment 5 and body segments 10, 15, 20 and 25, which extend the longitudinal length of bubbling bath mat 1. Preferably, segments 5, 10, 15, 20 and 25 are made of a rigid material.

Figure 2:
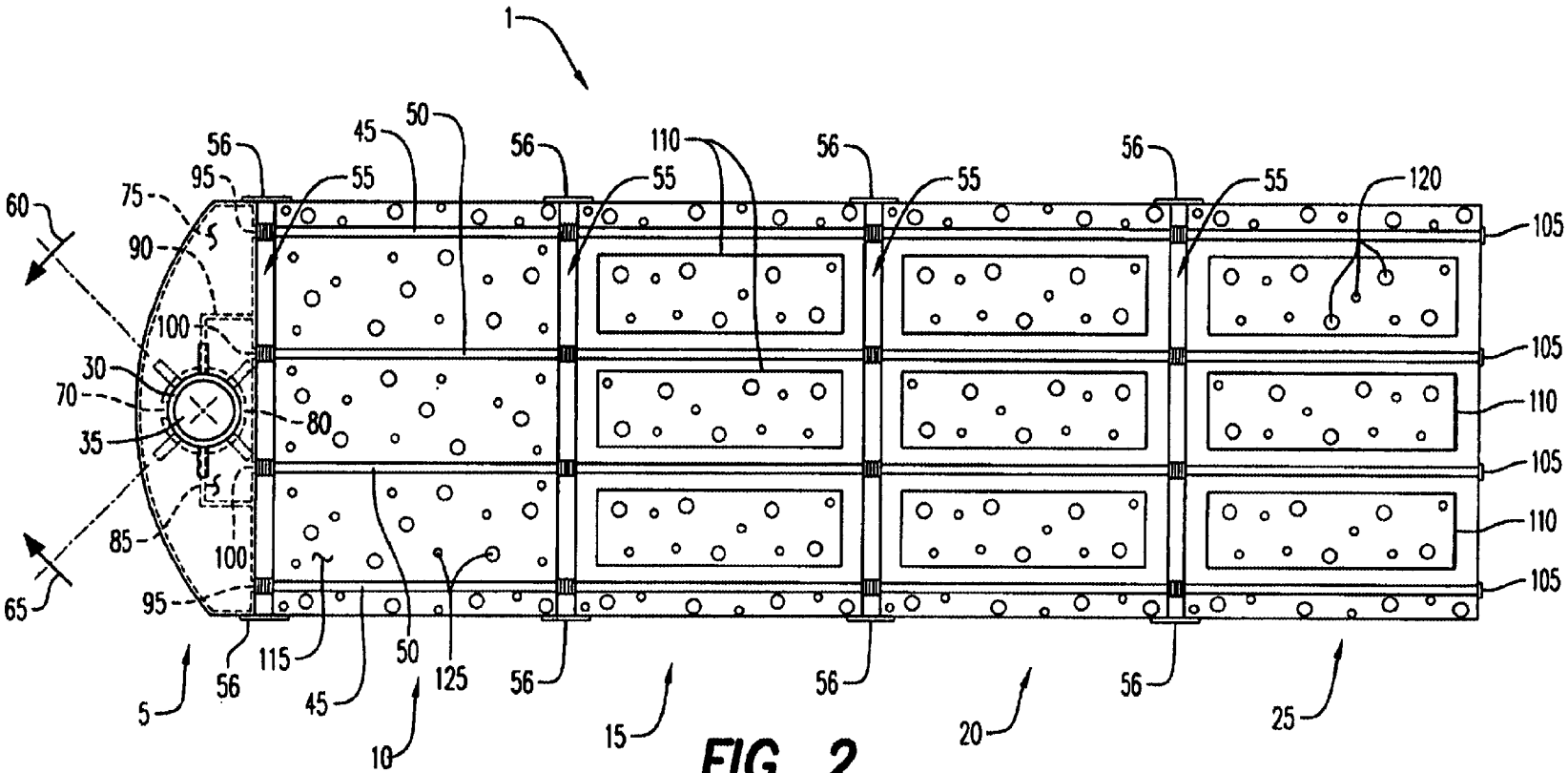
FIG. 2 is a top view of the bubbling bath mat of FIG. 1.

Head segment 5 has an air distributor controller 30. Preferably, air distributor controller 30 has an air inlet orifice 35 for receiving and engaging a hose 40. Referring to FIGS. 1 and 2, head segment 5 is connected to segment 10 by two or more air channels. Preferably, the air channels include at least two outer channels 45 and at least two inner channels 50. Outer channels 45 and inner channels 50 are adapted to extend the entire longitudinal length of bubbling bath mat 1 and to flexibly traverse joints 55. Outer channels 45 preferably run along opposing outer edges of mat 1 in the longitudinal direction. Inner channels 50 preferably run along an inner portion of mat 1 in the longitudinal direction.

Each segment 10, 15, 20 and 25 preferably has one or more apertures 125 randomly distributed throughout a surface 115 of each segment. Preferably, apertures 125 are differently sized. Segments 10, 15, 20 and 25 can be flexibly hinged together in any suitable manner, but preferably by link hinges 56 laterally spaced and diametrically opposed along the outer edge of bubbling bath mat 1 at one or more joints 55.

Referring to FIG. 2, head segment 5 has a first chamber 75, which surrounds a second chamber 85 and is separated from second chamber 85 by a wall structure 90. First chamber 75, preferably has at least two air orifices 95, which allow air to be fed from first chamber 75 to outer channels 45. Second chamber 85 preferably has one or more air orifices 100, which allow air to be fed from second chamber 85 to inner channels 50. Outer channels 45 and inner channels 50 preferably have removable end caps 105 to enable a user to drain water trapped inside said channels.

Air distributor controller 30 preferably bisects wall structure 90 to connect first chamber 75 and second chamber 85. Controller 30 preferably is also adapted to rotate. When controller 30 is rotated in a first direction into a first position 60, air can be forced through inlet orifice 35 and then through a first wall opening 70 into first chamber 75. When controller 30 is rotated in a second direction, opposite that of the first direction, into a second position 65, air can be forced through inlet orifice 35 and then through first wall opening 70 and a second wall opening 80 into both first chamber 75 and second chamber 85.

Figure 3:
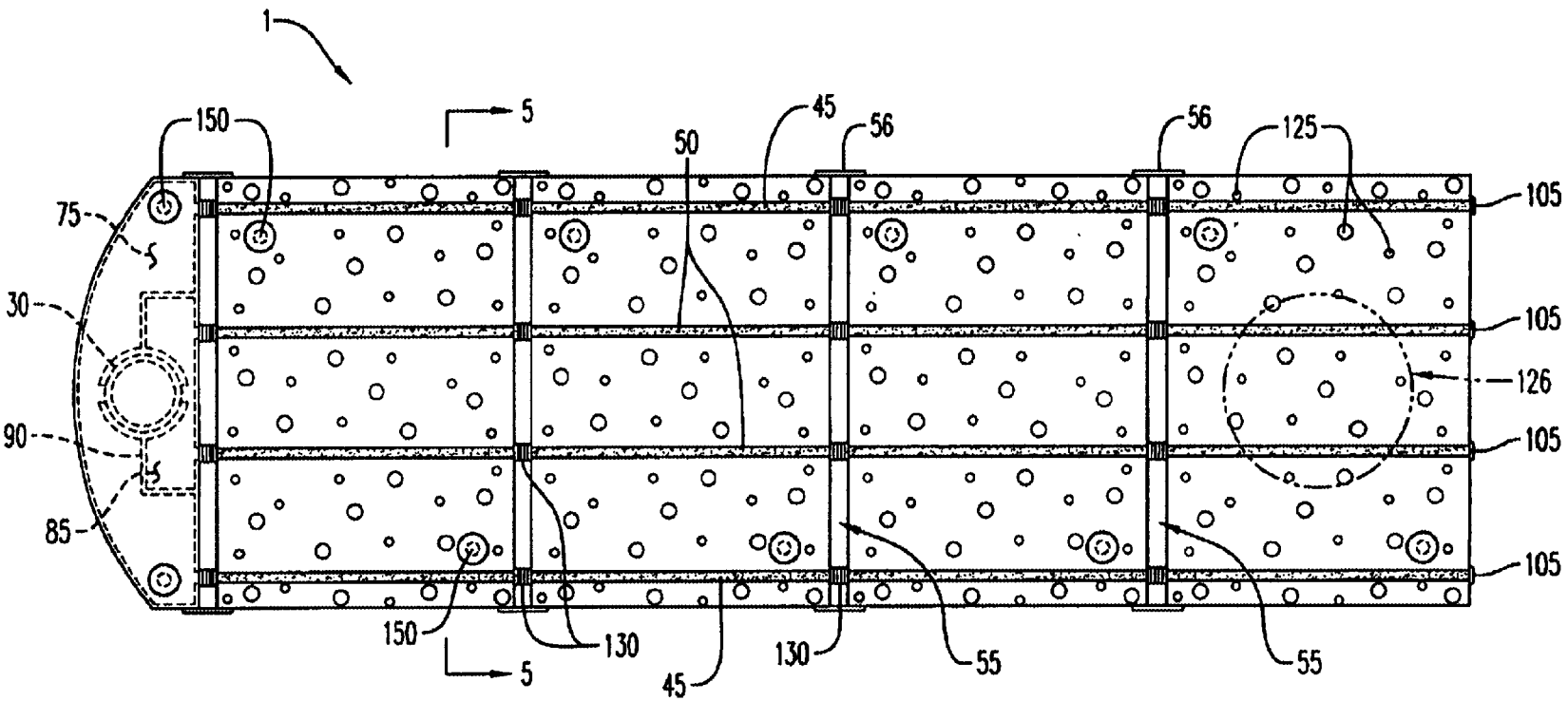
FIG. 3 is a bottom view of the bubbling bath mat of FIG. 1.
Figure 4:
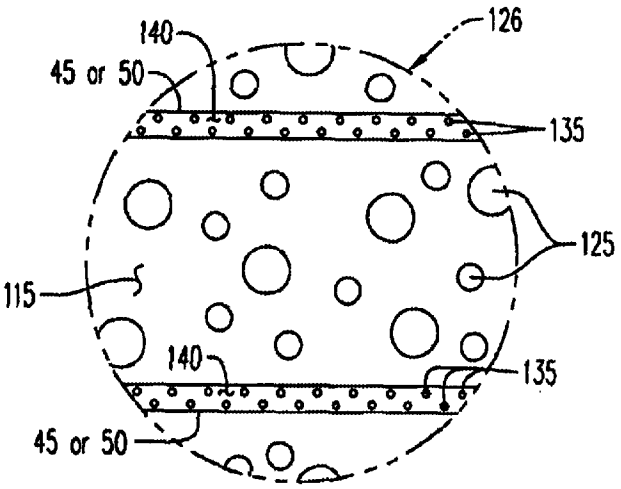
FIG. 4 is a blown up view of a portion of the bottom surface of the bubbling bath mat of FIG. 1, shown by circle 126.

Referring to FIGS. 3 and 4, for air to pass between segments 10, 15, 20 and 25, preferably outer channels 45 and inner channels 50 have sections of flexible hose 130 traversing joints 55. Preferably, each flexible hose section 130 is configured to provide enough rigidity to withstand collapse and enough flexibility to enable mat 1 to be folded as an integral unit.

Outer channels 45 and inner channels 50 preferably have a plurality of small apertures 135, which run along a bottom surface 140 of said channels for air to escape from mat 1. Air escaping from apertures 135 flows downward toward the surface of the tub or basin and then upward through apertures 125 in the surface of segments 10, 15, 20 and 25 producing bubbles of different sizes for a unique massaging effect.

Figure 5:
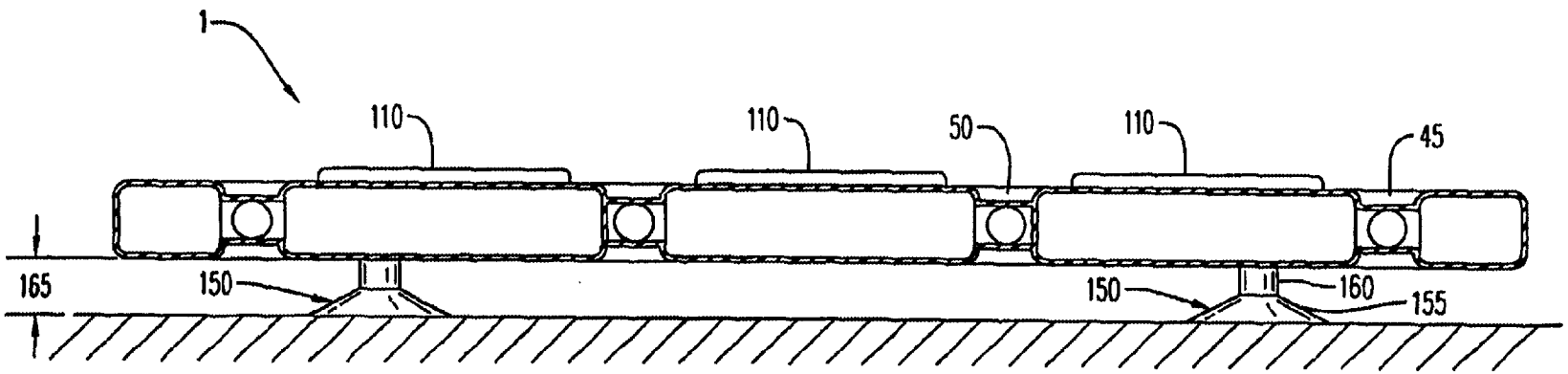
FIG. 5 is a section view taken along lines 5—5 of the bubbling bath mat of FIG. 1.

Referring to FIG. 5, bubbling bath mat 1 preferably has a plurality of suction cups 150 mounted to the bottom of segments 5, 10, 15, 20 and 25. Each suction cup 150 preferably has a lower concave cup portion 155 and a hollow cylindrical portion 160. Cup portions 155 preferably are adapted to contact the surface of a tub or basin to hold securely bubbling bath mat 1 in position. Each cylindrical portion 160 preferably is adapted to connect cup portions 155 to segments 5, 10, 15, 20 and 25. Each cylindrical portion 160 preferably creates a gap 165 between bottom surface 140 of channels 45 and 50 and the surface of the tub or basin. Gap 165 preferably functions to facilitate air bubble emanation.

Surface 115 of each segment 15, 20 and 25 has preferably a number of soft pads 110 preferably affixed thereto. Soft pads 110 preferably have a plurality of apertures 120 (shown in FIG. 2). Apertures 120 preferably are sized and distributed to correspond to and align with apertures 125 in the surface of segments 15, 20 and 25 so that air escaping from apertures 135 and flowing through apertures 125 is not inhibited.

Figure 6:
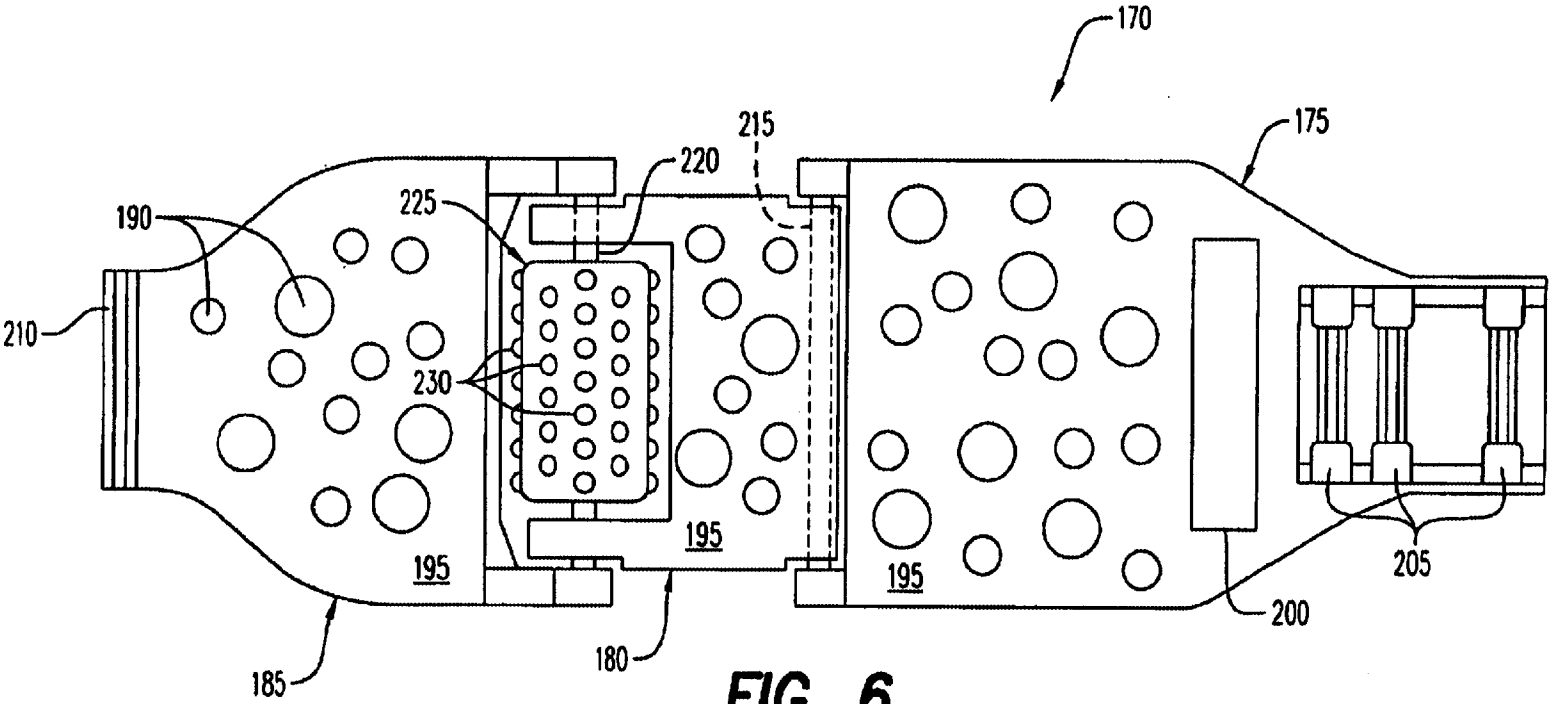
FIG. 6 is a top view of an attachment in accordance with a preferred embodiment of the present invention.
Figure 7:
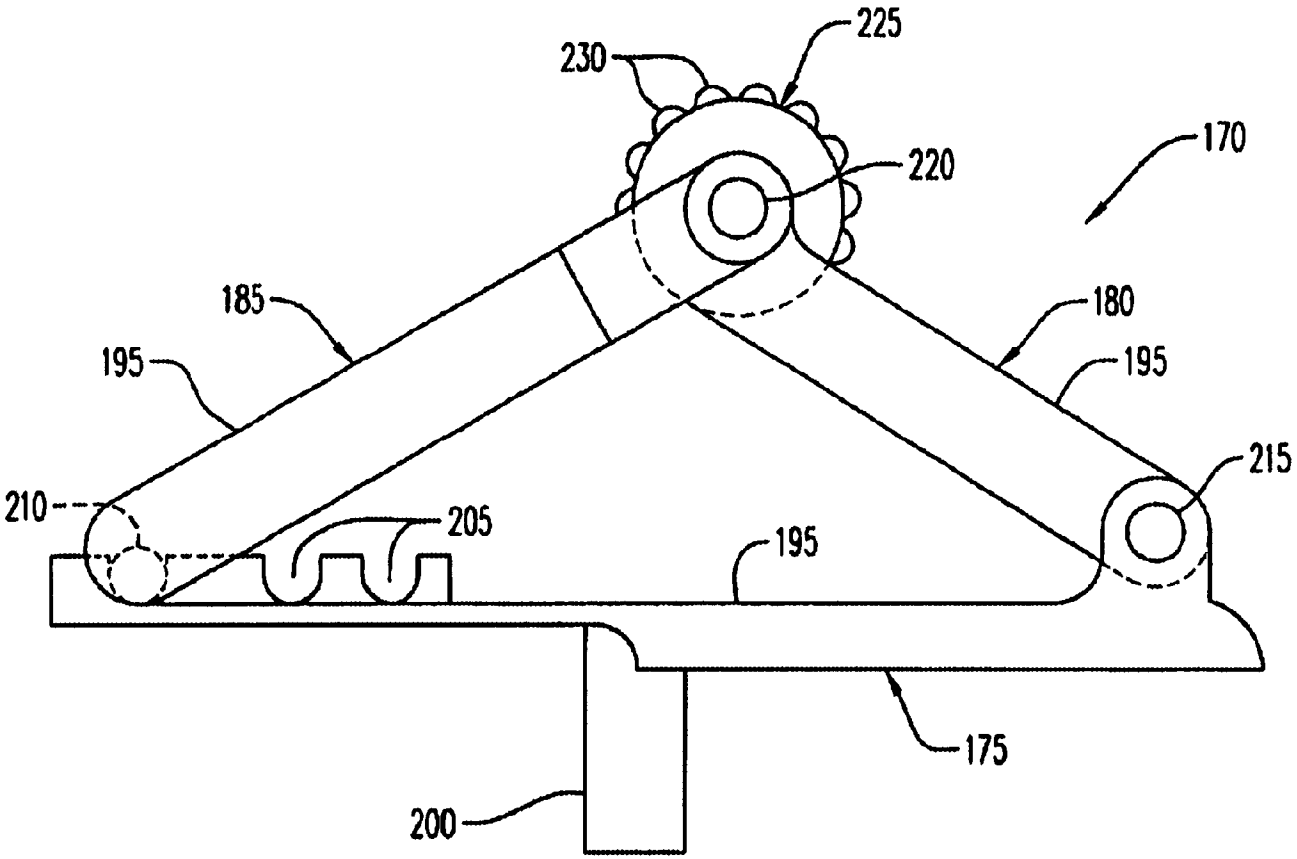
FIG. 7 is a side view of the attachment of FIG. 6 in an assembled position.

Referring to FIGS. 6 and 7, there is shown an attachment 170 in accordance with a preferred embodiment of the present invention. Attachment 170 preferably has three interconnected segments 175, 180 and 185. Each segment 175, 180, 185 has a surface 195 with two or more apertures 190. Preferably, apertures 190 are differently sized and randomly distributed.

Segment 175 preferably has an engager 200 for connecting attachment 170 to bubbling bath mat 1. Preferably, engager 200 is shaped to engage bubbling bath mat 1 at joints 55. For example, engager 200 can be shaped as shown in FIG. 7 to slide between segments 5 and 10, 10 and 15, 15 and 20, or 20 and 25. Segment 175 preferably also has a receiver 205 to adjustably receive and hold an engaging rod 210 located on segment 185. Preferably, segment 180 is located between segments 175 and 185 and pivotably connected to each segment 175 and 185 by any suitable structure, but preferably by hinge pins 215 and 220 respectively. Preferably, hinge pin 220 has a massaging roller 225 with two or more circular nodules 230 distributed over the surface of roller 225 to provide a therapeutic massaging effect.

In addition to the foregoing, bubbling bath mat 1, preferably can be adjustably fastened to the surface of a conventional tub or basin to accommodate different sitting positions. Segments 10, 15, 20 and 25 are preferably made of rigid material and flexibly hinged together at joints 55, to enable a user to affix mat 1, via suction cups 150, to the surface of a tub at various locations. For example, a user is able to fasten mat 1 to the surface of a tub such that one or more of the preferably rigid segments 10, 15, 20 and 25 are affixed to a back side surface of the tub and the remaining segments are affixed to a bottom surface of the tub. This arrangement would preferably allow a user to rest the majority of their weight on those segments fastened to the bottom surface and to lean back against those segments fastened to the side surface to receive an improved and more direct massaging effect to their back region.

Further, bubbling bath mat 1 preferably can be easily removed and folded up on itself into a compact size for efficient handling and storage. Joints 55, flexibly connecting segments 10, 15, 20 and 25, preferably have link hinges 56 that allow segment 10 to be folded over segment 15, segment 15 to be folded over segment 20, and segment 20 to be folded over segment 25. Thus, this combination of two or more rigid segments flexibly interconnected enables mat 1 to be conveniently folded.

Bubbling bath mat 1, in conjunction with a compressed air source (not shown) that produces heated air, preferably produces warm bubbles that help maintain water temperature. Still further, bubbling bath mat 1 may preferably be operated in conjunction with the compressed air source using a floating waterproof remote control device (not shown) to improve safety.

The present invention having been thus described with particular reference to the preferred forms thereof, it will be obvious that various changes and modifications may be made therein without departing from the spirit of the present invention as defined herein.

I claim:

1. A bubbling bath mat comprising:

a plurality of segments operatively and longitudinally connected together, each segment having a body made of rigid material, said body having a surface with a plurality of body apertures, some of said plurality of segments having a pad with a plurality of pad apertures, some of the plurality of body apertures align with some of the plurality of pad apertures;

an air controller having an inlet orifice for receiving compressed air; and a plurality of air channels for connecting together said plurality of segments, for receiving air from said air controller, and for directing said air to said plurality of segments, each of said plurality of air channels having a plurality of small apertures disposed to emit said air in a downward direction such that said air can flow through said one or more of said plurality of segments.

2. The mat of claim 1, further comprising an attachment connected to said mat for providing an additional massaging effect.

3. The mat of claim 2, wherein said attachment is a foot massager.

* * * * *